US011661312B2

(12) United States Patent
Murata

(10) Patent No.: US 11,661,312 B2
(45) Date of Patent: May 30, 2023

(54) HOISTING ROPE MONITORING DEVICE

(71) Applicant: Otis Elevator Company, Farmington, CT (US)

(72) Inventor: Jiro Murata, Oamishirasato (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 1158 days.

(21) Appl. No.: 16/260,731

(22) Filed: Jan. 29, 2019

(65) Prior Publication Data

US 2020/0239278 A1 Jul. 30, 2020

(51) Int. Cl.

| | |
|---|---|
| ***B66B 5/00*** | (2006.01) |
| ***B66B 5/02*** | (2006.01) |
| ***B66B 7/06*** | (2006.01) |
| ***B66B 7/08*** | (2006.01) |

(52) U.S. Cl.

CPC ..... *B66B 5/0031* (2013.01); *B66B 5/022* (2013.01); *B66B 7/068* (2013.01); *B66B 7/08* (2013.01)

(58) Field of Classification Search

CPC ..... B66B 5/0031; B66B 5/022; B66B 7/068; B66B 7/08; B66B 5/02; B66B 7/06; B66B 1/3423

See application file for complete search history.

(56) References Cited

U.S. PATENT DOCUMENTS

| | | | | |
|---|---|---|---|---|
| 6,123,176 | A | 9/2000 | O'Donnell et al. | |
| 9,038,783 | B2 | 5/2015 | Roberts et al. | |
| 9,096,411 | B2 | 8/2015 | Benosman et al. | |
| 9,242,838 | B2 | 1/2016 | Benosman | |
| 9,278,829 | B2 | 3/2016 | Benosman | |
| 9,327,942 | B2 | 5/2016 | Fukui et al. | |
| 9,475,674 | B2 | 10/2016 | Benosman et al. | |
| 9,862,570 | B2 | 1/2018 | Benosman et al. | |
| 9,914,619 | B2 | 3/2018 | Roberts et al. | |
| 2008/0196978 | A1* | 8/2008 | Siikonen | B66B 5/022 187/384 |
| 2009/0133963 | A1* | 5/2009 | Amano | B66B 5/022 187/247 |
| 2011/0303495 | A1* | 12/2011 | Kodera | B66B 5/022 187/384 |

(Continued)

FOREIGN PATENT DOCUMENTS

| | | |
|---|---|---|
| CN | 102398803 A | 4/2012 |
| CN | 102906001 B | 8/2015 |

(Continued)

OTHER PUBLICATIONS

European Search Report for Application No. 19215328.6; dated Jul. 10, 2020; 8 Pages.

(Continued)

*Primary Examiner* — Jeffrey Donels

(74) *Attorney, Agent, or Firm* — Cantor Colburn LLP

(57) ABSTRACT

According to one embodiment, a method for monitoring hoisting ropes in an elevator system comprises measuring tension of each hoisting rope, calculating a mean value of the tension in the hoisting ropes, determining if the tension in any rope is significantly higher than the mean value and providing a signal that rope snag has been detected if the tension in any rope is significantly higher than the mean value.

12 Claims, 6 Drawing Sheets

(56) References Cited

U.S. PATENT DOCUMENTS

| | | | | |
|---|---|---|---|---|
| 2014/0229011 | A1* | 8/2014 | Fukui | B66B 7/06 700/275 |
| 2017/0008734 | A1 | 1/2017 | Roberts et al. | |
| 2018/0016117 | A1 | 1/2018 | Palazzola et al. | |

FOREIGN PATENT DOCUMENTS

| | | | |
|---|---|---|---|
| CN | 104374508 | B | 8/2016 |
| CN | 207395939 | U | 5/2018 |
| JP | 2011195293 | A | 10/2011 |
| JP | 2016141519 | A | 8/2016 |
| WO | 2018172597 | A1 | 9/2018 |

OTHER PUBLICATIONS

Chinese Office Action for Application No. 201911408267.3; dated Sep. 6, 2021; 8 Pages.

* cited by examiner

HOISTING ROPE MONITORING DEVICE

BACKGROUND

This invention generally relates to elevator systems. More particularly, this invention relates to a hoisting rope monitoring device for monitoring the snagging of hoisting ropes.

Many elevator systems include an elevator car and counterweight that are suspended within a hoistway by roping comprising one or more hoisting ropes. Typically, wire ropes, cables or belts are used as the hoisting ropes for supporting the weight of the elevator car and counterweight and for moving the elevator car to desired positions within the hoistway. The hoisting ropes are typically routed about several sheaves according to a desired roping arrangement.

There are conditions where one or more of the hoisting ropes may begin to sway within the hoistway. Rope sway may occur, for example, during earthquakes or very high wind conditions because the building will move responsive to the earthquake or high winds. As the building moves, long ropes associated with the elevator car and counterweight will tend to sway from side to side. This is most prominent in high rise buildings where an amount of building sway is typically larger compared to shorter buildings and when the natural frequency of a rope within the hoistway is an integer multiple of the frequency of building sway.

Excessive rope sway of the hoisting ropes are undesirable for two main reasons; they can cause damage to the ropes or other equipment in the hoistway and their motion can produce objectionable vibration levels in the elevator car. The hoisting ropes may also snag or get caught on equipment in the hoistway such as rail brackets or hoistway doors due to rope sway. This may be dangerous if the elevator keeps on moving in such situation.

There are many ideas to prevent or detect the sway or snag of hoisting ropes. However, almost all of these ideas require additional or new devices which will decrease feasibility due to cost and technical difficulties.

BRIEF SUMMARY

According to one embodiment, a method for monitoring hoisting ropes in an elevator system comprises measuring tension of each hoisting rope, calculating a mean value of the tension in the hoisting ropes, determining if the tension in any rope is significantly higher than the mean value and providing a signal that rope snag has been detected if the tension in any rope is significantly higher than the mean value.

In addition to one or more of the features described above, or as an alternative, further embodiments may be included wherein measuring tension of each hoisting rope includes measuring tension by a tension gauge provided on each hoisting rope.

In addition to one or more of the features described above, or as an alternative, further embodiments may be included further comprising measuring tension of each hoisting rope while an elevator car is parked at a floor, calculating rope frequency and rope amplitude of each rope sway based on periodical fluctuation of the tension and moving an elevator car to a predetermined refuge floor if the rope amplitude is higher than a predetermined level.

In addition to one or more of the features described above, or as an alternative, further embodiments may be included wherein rope snag is checked when a rope sway with a rope amplitude higher than the predetermined level is detected.

In addition to one or more of the features described above, or as an alternative, further embodiments may be included wherein rope snag is checked after the rope sway has settled.

In addition to one or more of the features described above, or as an alternative, further embodiments may be included wherein moving the elevator car to a predetermined refuge floor includes moving the elevator car at a normal speed to the predetermined refuge floor when the rope amplitude is higher than a predetermined first level.

In addition to one or more of the features described above, or as an alternative, further embodiments may be included wherein moving the elevator car to a predetermined refuge floor includes moving the elevator car at a slow speed to the predetermined refuge floor and shutting down elevator operation when the rope amplitude is higher than a predetermined second level which is higher than the predetermined first level.

In addition to one or more of the features described above, or as an alternative, further embodiments may be included further comprising receiving an earthquake detection signal, shutting down elevator operation, determining if the earthquake and building sway has stopped and checking rope snag after the earthquake and building sway has stopped.

According to another embodiment, an elevator system comprises an elevator car vertically movable within a hoistway, a counterweight connected to the elevator car via a plurality of hoisting ropes and vertically movable within the hoistway and a hoisting rope monitoring device for monitoring the snagging of at least one hoisting rope, the hoisting rope monitoring device including a tension gauge provided on each hoisting rope and a controller which receives tension measurement of each hoisting rope from each tension gauge, calculates a mean value of the tension in the hoisting ropes, determines if the tension in any rope is significantly higher than the mean value, and provides a signal that rope snag has been detected if the tension in any rope is significantly higher than the mean value.

In addition to one or more of the features described above, or as an alternative, further embodiments may be included wherein the hoisting rope monitoring device further includes an earthquake sensor.

In addition to one or more of the features described above, or as an alternative, further embodiments may be included wherein the controller is an elevator controller.

In addition to one or more of the features described above, or as an alternative, further embodiments may be included wherein the controller further receives the tension measurement of each hoisting rope from each tension gauge while the elevator car is parked at a floor, calculates rope frequency and rope amplitude of each rope sway based on periodical fluctuation of the tension, and moves the elevator car to a predetermined refuge floor if the rope amplitude is higher than a predetermined level.

In addition to one or more of the features described above, or as an alternative, further embodiments may be included wherein rope snag is checked when a rope sway with a rope amplitude higher than the predetermined level is detected.

In addition to one or more of the features described above, or as an alternative, further embodiments may be included wherein the elevator controller further receives an earthquake detection signal from the earthquake sensor, shuts down elevator operation, determines if the earthquake and building sway has stopped and checks rope snag after the earthquake and building sway has stopped.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the disclosure are apparent from the following detailed description taken in conjunction with the accompanying drawings in which like elements are numbered alike in the several FIGS.

DETAILED DESCRIPTION

Figure 1:
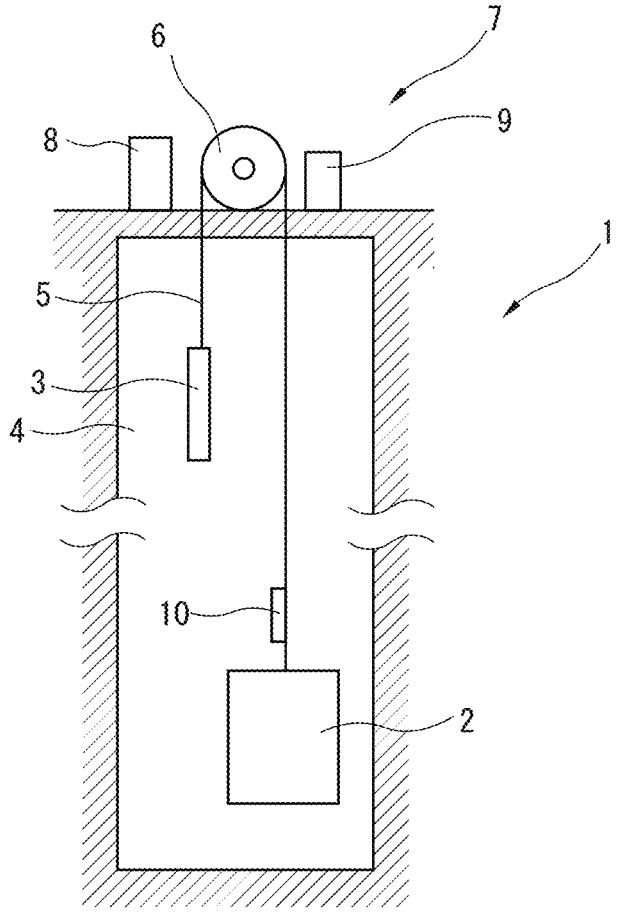
FIG. 1 illustrates a schematic view of an elevator system including the hoisting rope monitoring device of the present invention.

FIG. 1 schematically shows selected portions of an elevator system 1 of the present invention. An elevator car 2 and counterweight 3 are both vertically movable within a hoistway 4. A plurality of hoisting ropes 5 couple the elevator car 2 to the counterweight 3. In this embodiment, the hoisting ropes 5 comprise round steel ropes but the hoisting ropes 5 may comprise belts including a plurality of longitudinally extending wire cords and a coating covering the wire cords. A variety of roping configurations may be useful in an elevator system that includes features designed according to an embodiment of this invention.

The hoisting ropes 5 extend over a traction sheave 6 that is driven by a machine (not shown) positioned in a machine room 7 or in an upper portion of the hoistway 4. Traction between the sheave 6 and the hoisting ropes 5 drives the car 2 and counterweight 3 through the hoistway 4. Operation of the machine is controlled by an elevator controller 8 which may be positioned in the machine room 7. An earthquake sensor 9 for detecting an earthquake is also provided in the machine room 7 or in the proximity of the building including the elevator system 1. The earthquake sensor 9 provides an earthquake detection signal to the elevator controller 8. A tension gauge 10 is provided on each rope 5 above the elevator car 2. Each tension gauge 10 provides measured tension values to the elevator controller 8 via wired or wireless communication. The elevator controller 8 uses the measured tension values to calculate the load in the car 2, as is conventional.

The hoisting rope monitoring device of the present invention is comprised of the elevator controller 8, the earthquake sensor 9 and the tension gauges 10 provided on the hoisting ropes 5 which all may be existing components of a conventional elevator system.

Figure 2:
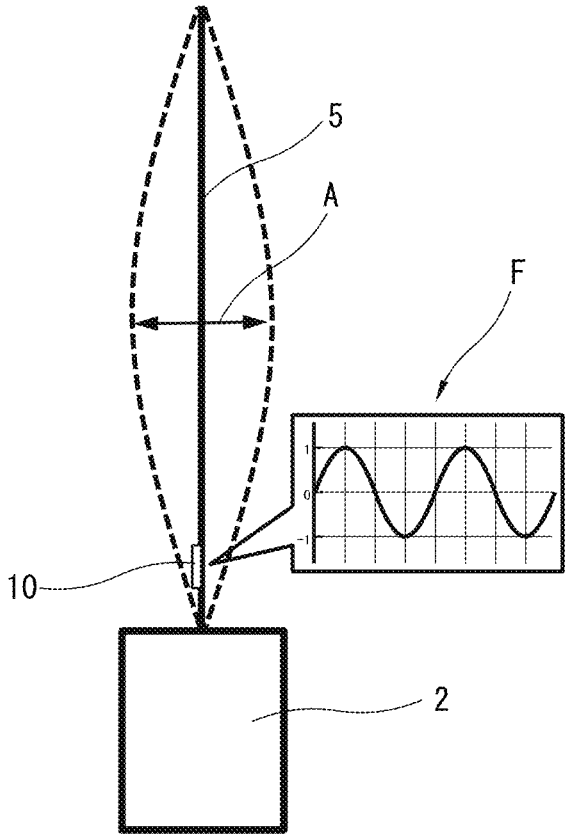
FIG. 2 illustrates a schematic view of the elevator system of FIG. 1 with the hoisting ropes swaying.

FIG. 2 shows the hoisting ropes 5 swaying due to an earthquake or very high wind conditions. The sway, i.e., the lateral swinging motion of the hoisting ropes 5 causes the rope tension in the ropes 5 to periodically fluctuate. The elevator controller 8 of the present invention calculates the frequency F and amplitude A of rope sway of the hoisting ropes 5 from the periodical fluctuation of the measured rope tension values input from the tension gauges 10.

Figure 3:
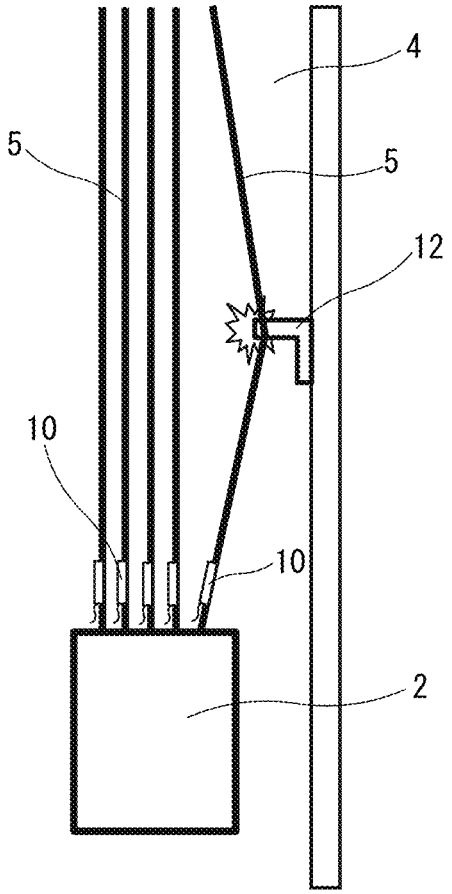
FIG. 3 illustrates a schematic view of the elevator system of FIG. 1 with one of the hoisting ropes caught on a structure in the hoistway.

FIG. 3 shows one of the hoisting ropes 5, the rightmost hoisting rope 5, snagged or caught on a structure 12 in the hoistway such as a rail bracket or hoistway door. In this situation, the tension in the snagged rope 5 will become significantly higher compared to the other ropes 5.

Figure 4:
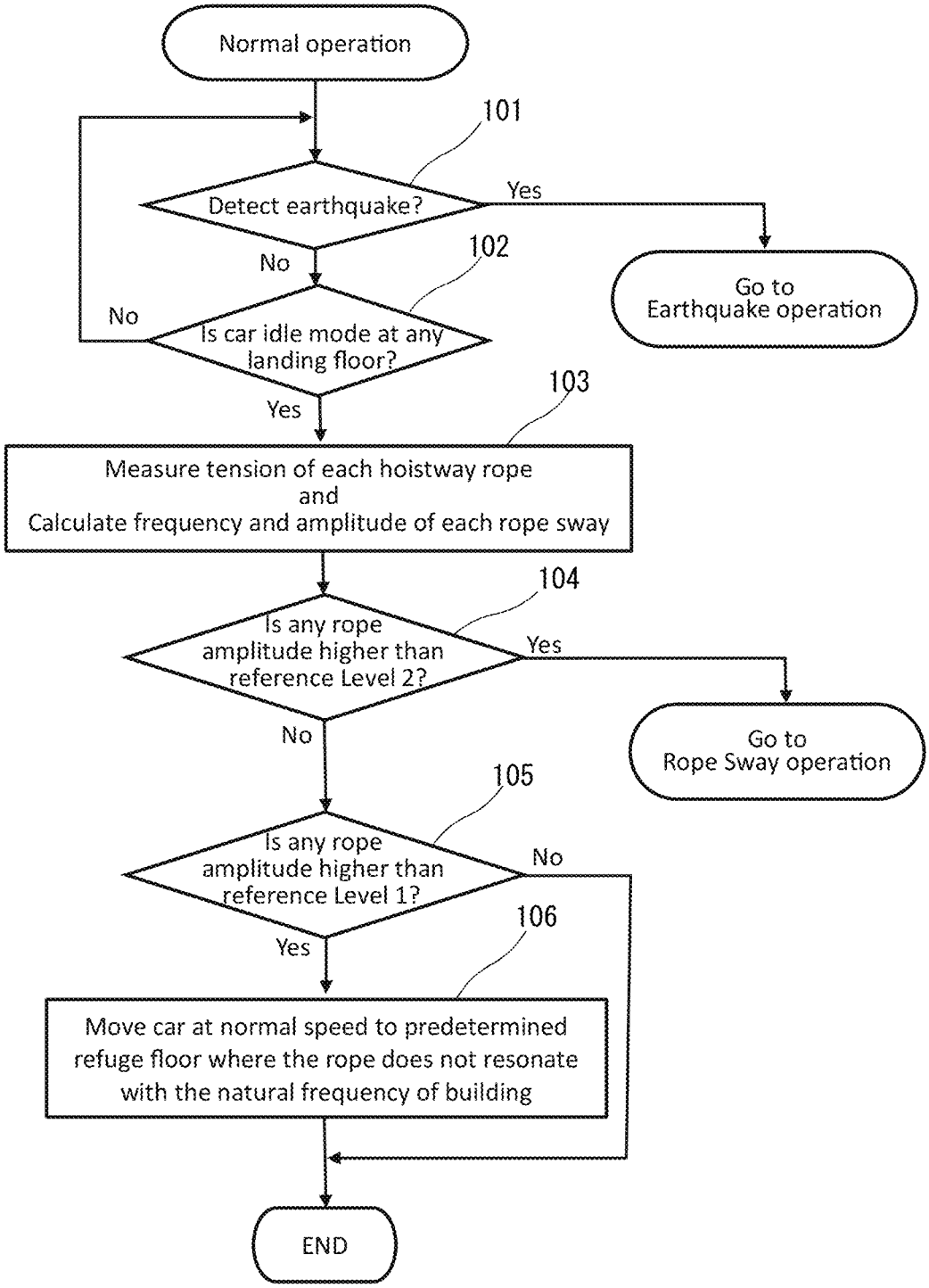
FIG. 4 is a flowchart showing the process of normal operation which may be performed by the elevator controller of FIG. 1.
Figure 5:
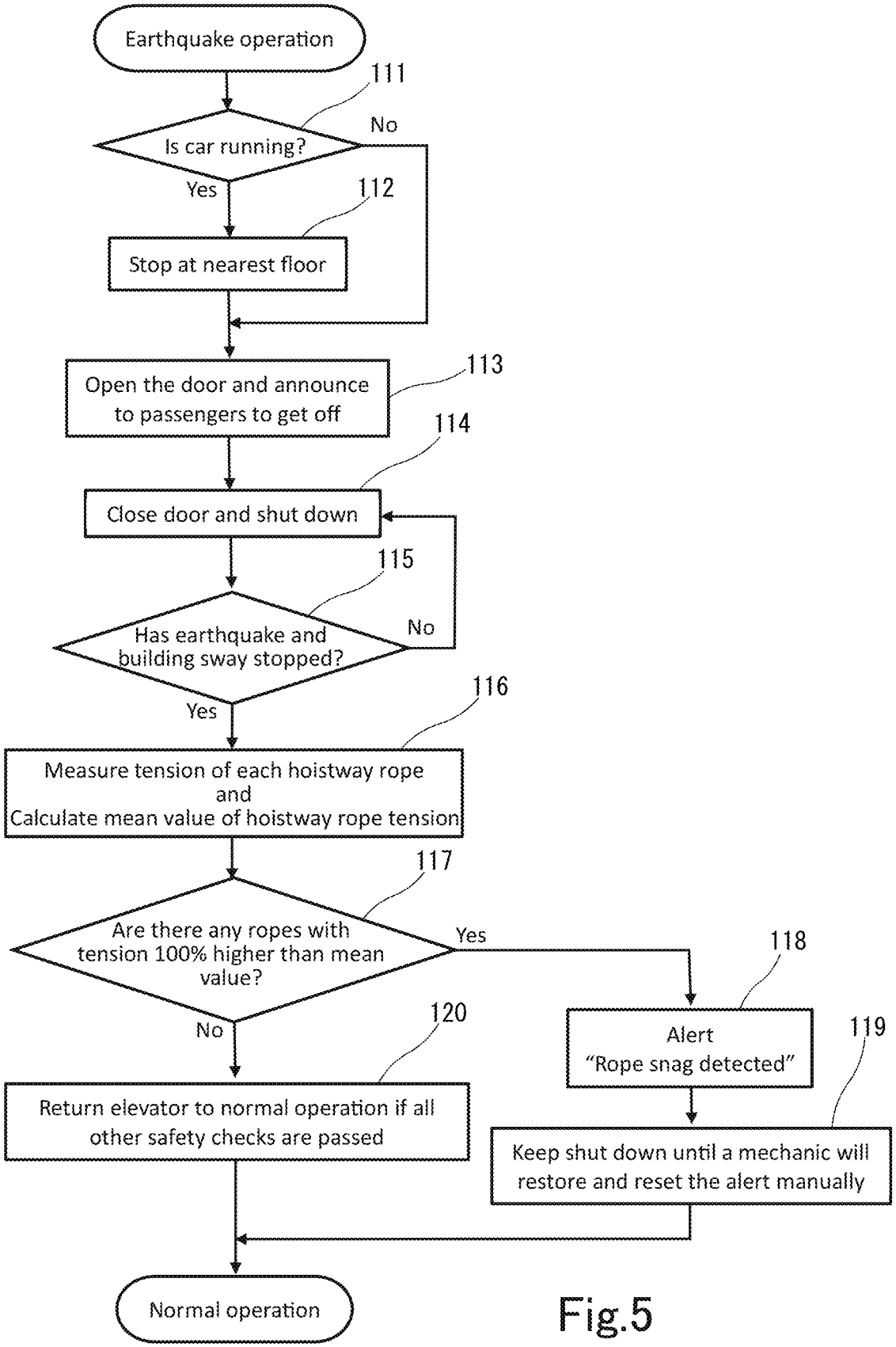
FIG. 5 is a flowchart showing the process of earthquake operation which may be performed by the elevator controller of FIG. 1.
Figure 6:
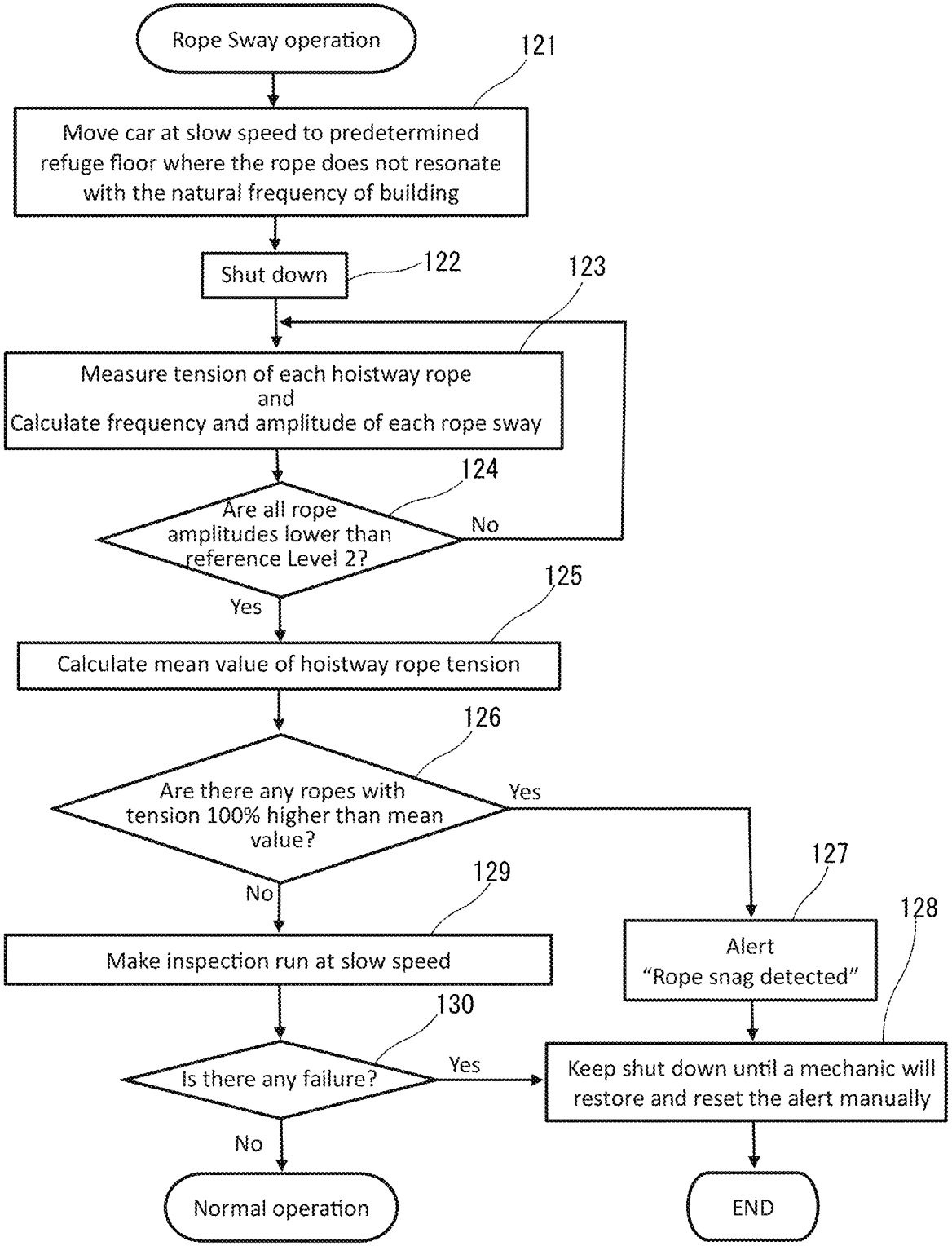
FIG. 6 is a flowchart showing the process of rope sway operation which may be performed by the elevator controller of FIG. 1.

FIGS. 4 to 6 show the process performed by the elevator controller 8 of the present invention for monitoring the swaying or snagging of hoisting ropes 5. FIG. 4 shows the process performed during normal operation. In step 101, it is checked if an earthquake has been detected by the earthquake sensor 9. If yes, the process proceeds to earthquake operation. If no, the process proceeds to step 102 to check whether the car 2 is in an idle mode at any landing floor. If no, the process waits until the car 2 switches to an idle mode. If yes, the tension of each hoistway rope 5 is measured and the frequency and amplitude of each rope sway is calculated in step 103.

In step 104, it is checked if the amplitude of any rope 5 is higher than a second reference level. If yes, the process proceeds to rope sway operation. If no, it is checked if the amplitude of any rope 5 is higher than a first reference level. The second reference level is larger than the first reference level (second reference level>first reference level). If yes, the car 2 is moved at a normal speed to a predetermined refuge floor where the hoisting ropes 5 do not resonate with the natural frequency of the building and the process ends at END. The refuge floor may be determined beforehand based on the natural frequency of the building and the natural frequency of the hoisting ropes 5 with the elevator car 2 parked at each floor. If no, the process proceeds directly to END. The process of steps 101 to 106 is repeated while the elevator is in an idle mode. As soon as the elevator controller 8 receives a car call, the process is interrupted to respond to the call.

FIG. 5 shows the process performed during earthquake operation. In step 111, it is checked if the car 2 is running. If yes, the car 2 is stopped at the nearest floor in step 112 and the door is opened and an announcement to get off the elevator car 2 is provided to passengers in step 113. After making sure that all passengers have exited the elevator car 2, such as by checking the load inside the car 2, the doors are closed and elevator operation is shut down in step 114.

In step 115, it is checked if the earthquake and building sway has stopped. If no, the process repeats steps 114 and 115 until the earthquake and building sway stops. Once the earthquake and building sway stops, the process proceeds to step 116, measures the tension of each hoisting rope 5 and calculates a mean value of the tension in the hoisting ropes 5.

Next, it is checked if there are any ropes 5 with a tension 100% higher than the mean value. It is to be understood that 100% is merely an example and the percentage should be determined based on elevator/building configuration and on customer requirements. If yes, a signal indicating rope snag is sent to an operator or a remote center and an alert "Rope snag detected" may be provided in step 118. Elevator operation is kept shut down until a mechanic arrives at the site to restore the elevator and reset the alert manually in step 119. If no, the process proceeds to step 120 and the elevator returns to normal operation once all other safety checks are passed.

FIG. 6 shows the process performed during rope sway operation. In step 121, the car 2 is moved at a slow speed to a predetermined refuge floor where the rope 5 does not resonate with the natural frequency of the building. As previously explained, the refuge floor may be determined beforehand based on the natural frequency of the building and the natural frequency of the hoisting ropes 5 with the elevator car 2 parked at each floor. Then elevator operation is shut down in step 122. In step 123, the tension of each hoisting rope 5 is measured and the frequency and amplitude of each rope sway is calculated. In step 124, it is checked if the amplitudes of all ropes 5 are lower than the second reference level. If no, steps 123 and 124 are repeated until the amplitudes of all ropes 5 become lower than the second reference level. If yes, the mean value of the tension in the hoisting ropes 5 is calculated in step 125.

Next, it is checked if there are any ropes 5 with tension 100% higher than the mean value in step 126. It is to be understood that 100% is merely an example and that the percentage should be determined based on elevator/building configuration and on customer requirements. If yes, a signal indicating the detection of rope snag is sent to an operator or a remote center and an alert "Rope snag detected" may be provided in step 127. Elevator operation is kept shut down until a mechanic arrives at the site to restore and reset the alert manually in step 128 and the process ends at END. If no, the process proceeds to step 129 and an inspection run of the elevator is performed at a slow speed.

In step 130, it is checked if there is any failure. If yes, the process proceeds to step 128 and keeps elevator operation shut down until a mechanic arrives at the site to restore and reset the alert manually. If no, the process returns to normal operation.

The terminology used herein is for the purpose of describing particular embodiments only and is not intended to be limiting. While the description has been presented for purposes of illustration and description, it is not intended to be exhaustive or limited to embodiments in the form disclosed. Many modifications, variations, alterations, substitutions or equivalent arrangement not hereto described will be apparent to those of ordinary skill in the art without departing from the scope of the disclosure. Additionally, while the various embodiments have been described, it is to be understood that aspects may include only some of the described embodiments. Accordingly, the disclosure is not to be seen as limited by the foregoing description, but is only limited by the scope of the appended claims.

What is claimed is:

1. A method for monitoring hoisting ropes in an elevator system, comprising:

measuring tension of each hoisting rope;

calculating a mean value of the tension in the hoisting ropes;

determining if the tension in any rope is significantly higher than the mean value;

providing a signal that rope snag has been detected if the tension in any rope is significantly higher than the mean value;

measuring tension of each hoisting rope while an elevator car is parked at a floor;

calculating rope frequency and rope amplitude of each rope sway based on periodical fluctuation of the tension; and moving an elevator car to a predetermined refuge floor if the rope amplitude is higher than a predetermined level.

2. The method of claim 1, wherein measuring tension of each hoisting rope includes measuring tension by a tension gauge provided on each hoisting rope.

3. The method of claim 1, wherein rope snag is checked when a rope sway with a rope amplitude higher than the predetermined level is detected.

4. The method of claim 1, wherein rope snag is checked after the rope sway has settled.

5. The method of claim 1, wherein moving the elevator car to a predetermined refuge floor includes moving the elevator car at a normal speed to the predetermined refuge floor when the rope amplitude is higher than a predetermined first level.

6. The method of claim 5, wherein moving the elevator car to a predetermined refuge floor includes moving the elevator car at a slow speed to the predetermined refuge floor and shutting down elevator operation when the rope amplitude is higher than a predetermined second level which is higher than the predetermined first level.

7. A method for monitoring hoisting ropes in an elevator system, comprising:

measuring tension of each hoisting rope;

calculating a mean value of the tension in the hoisting ropes;

determining if the tension in any rope is significantly higher than the mean value;

providing a signal that rope snag has been detected if the tension in any rope is significantly higher than the mean value;

receiving an earthquake detection signal;

shutting down elevator operation;

determining if the earthquake and building sway has stopped; and checking rope snag after the earthquake and building sway has stopped.

8. An elevator system comprising:

an elevator car vertically movable within a hoistway;

a counterweight connected to the elevator car via a plurality of hoisting ropes and vertically movable within the hoistway; and a hoisting rope monitoring device for monitoring the snagging of at least one hoisting rope, the hoisting rope monitoring device including:

a tension gauge provided on each hoisting rope; and a controller which receives tension measurement of each hoisting rope from each tension gauge, calculates a mean value of the tension in the hoisting ropes, determines if the tension in any rope is significantly higher than the mean value, and provides a signal that rope snag has been detected if the tension in any rope is significantly higher than the mean value;

wherein the controller further receives the tension measurement of each hoisting rope from each tension gauge while the elevator car is parked at a floor, calculates rope frequency and rope amplitude of each rope sway based on periodical fluctuation of the tension, and moves the elevator car to a predetermined refuge floor if the rope amplitude is higher than a predetermined level.

9. The elevator system of claim 8, wherein the hoisting rope monitoring device further includes an earthquake sensor.

10. The elevator system of claim 8, wherein the controller is an elevator controller.

11. The elevator system of claim 8 wherein rope snag is checked when a rope sway with a rope amplitude higher than the predetermined level is detected.

12. The elevator system of claim 9, wherein the elevator controller further receives an earthquake detection signal from the earthquake sensor, shuts down elevator operation, determines if the earthquake and building sway has stopped and checks rope snag after the earthquake and building sway has stopped.

* * * * *